US009177526B2

(12) United States Patent
Fujio et al.

(10) Patent No.: US 9,177,526 B2
(45) Date of Patent: Nov. 3, 2015

(54) APPARATUS AND METHOD FOR SETTING DISPLAY DEVICE, AND NON-TRANSITORY COMPUTER READABLE MEDIUM

(71) Applicant: FUJI XEROX Co., Ltd., Minato-ku, Tokyo (JP)

(72) Inventors: Makoto Fujio, Kanagawa (JP); Noriko Sakai, Kanagawa (JP); Toshihiro Iwafuchi, Kanagawa (JP); Daigo Hama, Kanagawa (JP); Kazuhiko Horikawa, Kanagawa (JP); Chizuru Yamazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/148,145

(22) Filed: Jan. 6, 2014

(65) Prior Publication Data

US 2014/0362065 A1 Dec. 11, 2014

(30) Foreign Application Priority Data

Jun. 6, 2013 (JP) ..... 2013-120194

(51) Int. Cl.
*G09G 5/02* (2006.01)

(52) U.S. Cl.
CPC ..... *G09G 5/02* (2013.01)

(58) Field of Classification Search
CPC ..... G09G 5/02; G09G 5/10; G09G 3/36
See application file for complete search history.

(56) References Cited

U.S. PATENT DOCUMENTS 7,271,790 B2 * 9/2007 Hudson et al. ..... 345/88
8,294,735 B2 * 10/2012 Chao et al. ..... 345/690

FOREIGN PATENT DOCUMENTS

JP 2007-142983 A 6/2007
JP 2008-086002 A 4/2008

* cited by examiner

*Primary Examiner* — Andrew Sasinowski
(74) *Attorney, Agent, or Firm* — Sughrue Mion, PLLC

(57) ABSTRACT

An apparatus for setting a display device includes a target value obtainer, a measured value obtainer, and a determiner. The target value obtainer acquires a target value of a display setting including color temperature and brightness for a display device configured to display an image. The measured value obtainer acquires a measured value of display characteristics including the color temperature and the brightness in each of multiple states specific to the display device, from the display device for which the display setting is sequentially changed to the multiple states. The determiner determines a setting value in the display setting including the color temperature and the brightness from among the multiple states, on the basis of the target value and multiple measured values acquired by the measured value obtainer.

13 Claims, 12 Drawing Sheets

FIG. 4

| COLOR TEMPERATURE / BRIGHTNESS | LOW | INTERMEDIATE-LOW | INTERMEDIATE | INTERMEDIATE-HIGH | HIGH |
|---|---|---|---|---|---|
| DARK | FIRST SETTING Set1 | SECOND SETTING Set2 | THIRD SETTING Set3 | FOURTH SETTING Set4 | FIFTH SETTING Set5 |
| INTERMEDIATE | SIXTH SETTING Set6 | SEVENTH SETTING Set7 | EIGHTH SETTING Set8 | NINTH SETTING Set9 | TENTH SETTING Set10 |
| BRIGHT | ELEVENTH SETTING Set11 | TWELFTH SETTING Set12 | THIRTEENTH SETTING Set13 | FOURTEENTH SETTING Set14 | FIFTEENTH SETTING Set15 |

FIG. 7

| MEASURED VALUE M | MEASUREMENT CONDITION | MEASURED COLOR TEMPERATURE VALUE Mt | | MEASURED BRIGHTNESS VALUE Mb | |
|---|---|---|---|---|---|
| FIRST MEASURED VALUE M1 | FIRST SETTING Set1 | FIRST MEASURED COLOR TEMPERATURE VALUE Mt1 | 4500 K | FIRST MEASURED BRIGHTNESS VALUE Mb1 | 70 cd/m$^2$ |
| SECOND MEASURED VALUE M2 | THIRD SETTING Set3 | SECOND MEASURED COLOR TEMPERATURE VALUE Mt2 | 5500 K | SECOND MEASURED BRIGHTNESS VALUE Mb2 | 110 cd/m$^2$ |
| THIRD MEASURED VALUE M3 | FIFTH SETTING Set5 | THIRD MEASURED COLOR TEMPERATURE VALUE Mt3 | 8000 K | THIRD MEASURED BRIGHTNESS VALUE Mb3 | 130 cd/m$^2$ |
| FOURTH MEASURED VALUE M4 | SIXTH SETTING Set6 | FOURTH MEASURED COLOR TEMPERATURE VALUE Mt4 | 4800 K | FOURTH MEASURED BRIGHTNESS VALUE Mb4 | 100 cd/m$^2$ |
| FIFTH MEASURED VALUE M5 | EIGHTH SETTING Set8 | FIFTH MEASURED COLOR TEMPERATURE VALUE Mt5 | 6500 K | FIFTH MEASURED BRIGHTNESS VALUE Mb5 | 120 cd/m$^2$ |
| SIXTH MEASURED VALUE M6 | TENTH SETTING Set10 | SIXTH MEASURED COLOR TEMPERATURE VALUE Mt6 | 9000 K | SIXTH MEASURED BRIGHTNESS VALUE Mb6 | 150 cd/m$^2$ |
| SEVENTH MEASURED VALUE M7 | ELEVENTH SETTING Set11 | SEVENTH MEASURED COLOR TEMPERATURE VALUE Mt7 | 5000 K | SEVENTH MEASURED BRIGHTNESS VALUE Mb7 | 170 cd/m$^2$ |
| EIGHTH MEASURED VALUE M8 | THIRTEENTH SETTING Set13 | EIGHTH MEASURED COLOR TEMPERATURE VALUE Mt8 | 7000 K | EIGHTH MEASURED BRIGHTNESS VALUE Mb8 | 190 cd/m$^2$ |
| NINTH MEASURED VALUE M9 | FIFTEENTH SETTING Set15 | NINTH MEASURED COLOR TEMPERATURE VALUE Mt9 | 10000 K | NINTH MEASURED BRIGHTNESS VALUE Mb9 | 200 cd/m$^2$ |

FIG. 8

| PREDICTED VALUE P | PREDICTION CONDITION | PREDICTED COLOR TEMPERATURE VALUE Pt | | PREDICTED BRIGHTNESS VALUE Pb | |
|---|---|---|---|---|---|
| FIRST PREDICTED VALUE P1 | SECOND SETTING Set2 | FIRST PREDICTED COLOR TEMPERATURE VALUE Pt1 | 5000 K | FIRST PREDICTED BRIGHTNESS VALUE Pb1 | 90 cd/$m^2$ |
| SECOND PREDICTED VALUE P2 | FOURTH SETTING Set4 | SECOND PREDICTED COLOR TEMPERATURE VALUE Pt2 | 6800 K | SECOND PREDICTED BRIGHTNESS VALUE Pb2 | 125 cd/$m^2$ |
| THIRD PREDICTED VALUE P3 | SEVENTH SETTING Set7 | THIRD PREDICTED COLOR TEMPERATURE VALUE Pt3 | 5500 K | THIRD PREDICTED BRIGHTNESS VALUE Pb3 | 110 cd/$m^2$ |
| FOURTH PREDICTED VALUE P4 | NINTH SETTING Set9 | FOURTH PREDICTED COLOR TEMPERATURE VALUE Pt4 | 7800 K | FOURTH PREDICTED BRIGHTNESS VALUE Pb4 | 135 cd/$m^2$ |
| FIFTH PREDICTED VALUE P5 | TWELFTH SETTING Set12 | FIFTH PREDICTED COLOR TEMPERATURE VALUE Pt5 | 6000 K | FIFTH PREDICTED BRIGHTNESS VALUE Pb5 | 180 cd/$m^2$ |
| SIXTH PREDICTED VALUE P6 | FOURTEENTH SETTING Set14 | SIXTH PREDICTED COLOR TEMPERATURE VALUE Pt6 | 8500 K | SIXTH PREDICTED BRIGHTNESS VALUE Pb6 | 195 cd/$m^2$ |

FIG. 10

| MEASUREMENT CONDITION (PREDICTION CONDITION) | MEASURED VALUE (PREDICTED VALUE) | COLOR TEMPERATURE | | | | | BRIGHTNESS | | | | | ADJUSTED DIFFERENCE Da |
|---|---|---|---|---|---|---|---|---|---|---|---|---|
| | | TARGET COLOR TEMPERATURE VALUE Tt | MEASURED COLOR TEMPERATURE VALUE Mt (PREDICTED COLOR TEMPERATURE VALUE Pt) | COLOR TEMPERATURE DIFFERENCE Dt | COLOR TEMPERATURE WEIGHTING FACTOR Wt | ADJUSTED COLOR TEMPERATURE DIFFERENCE Dat | TARGET BRIGHTNESS VALUE Tb | MEASURED BRIGHTNESS VALUE Mb (PREDICTED LUMINANCE VALUE Pb) | BRIGHTNESS DIFFERENCE Db | BRIGHTNESS WEIGHTING FACTOR Wb | ADJUSTED BRIGHTNESS DIFFERENCE Dab | |
| Set1 | M1 | 6500 | 4500 | -2000 | 0.04 | 80 | 100 | 70 | -30 | 7 | 210 | 290 |
| Set2 | P1 | | 5000 | -1500 | 0.03 | 45 | | 90 | -10 | 3 | 30 | 75 |
| Set3 | M2 | | 5500 | -1000 | 0.02 | 20 | | 110 | +10 | 1 | 10 | 30 |
| Set4 | P2 | | 6800 | +300 | 0.005 | 15 | | 125 | +25 | 1 | 25 | 40 |
| Set5 | M3 | | 8000 | +1500 | 0.04 | 60 | | 130 | +30 | 1 | 30 | 90 |
| Set6 | M4 | | 4800 | -1700 | 0.035 | 59.5 | | 100 | 0 | 1 | 0 | 59.5 |
| Set7 | P3 | | 5500 | -1000 | 0.02 | 20 | | 110 | +10 | 1 | 10 | 30 |
| Set8 | M5 | | 6500 | 0 | 0 | 0 | | 120 | +20 | 1 | 20 | 20 |
| Set9 | P4 | | 7800 | +1300 | 0.025 | 32.5 | | 135 | +35 | 1 | 35 | 67.5 |
| Set10 | M6 | | 9000 | +2500 | 0.05 | 125 | | 150 | +50 | 1 | 50 | 175 |
| Set11 | M7 | | 5000 | -1500 | 0.03 | 45 | | 170 | +70 | 1 | 70 | 115 |
| Set12 | P5 | | 6000 | -500 | 0.01 | 5 | | 180 | +80 | 1 | 80 | 85 |
| Set13 | M8 | | 7000 | +500 | 0.01 | 5 | | 190 | +90 | 1 | 90 | 95 |
| Set14 | P6 | | 8500 | +1500 | 0.045 | 67.5 | | 195 | +95 | 1 | 95 | 162.5 |
| Set15 | M9 | | 10000 | +3500 | 0.07 | 245 | | 200 | +100 | 1 | 100 | 345 |

APPARATUS AND METHOD FOR SETTING DISPLAY DEVICE, AND NON-TRANSITORY COMPUTER READABLE MEDIUM

CROSS-REFERENCE TO RELATED APPLICATIONS

This application is based on and claims priority under 35 USC 119 from Japanese Patent Application No. 2013-120194 filed Jun. 6, 2013.

BACKGROUND

Technical Field

The present invention relates to an apparatus and method for setting a display device, and a non-transitory computer readable medium.

SUMMARY

According to an aspect of the invention, there is provided an apparatus for setting a display device, including a target value obtainer, a measured value obtainer, and a determiner. The target value obtainer acquires a target value of a display setting including color temperature and brightness for a display device configured to display an image. The measured value obtainer acquires a measured value of display characteristics including the color temperature and the brightness in each of multiple states specific to the display device, from the display device for which the display setting is sequentially changed to the multiple states. The determiner determines a setting value in the display setting including the color temperature and the brightness from among the multiple states, on the basis of the target value and multiple measured values acquired by the measured value obtainer.

BRIEF DESCRIPTION OF THE DRAWINGS

An exemplary embodiment of the present invention will be described in detail based on the following figures, wherein:

FIG. 4 is a table illustrating a list of display settings for a display device according to the exemplary embodiment;

FIG. 7 is a table illustrating an example of measured values acquired in step S104 illustrated in FIG. 5;

FIG. 8 is a table illustrating an example of predicted values predicted in step S108 illustrated in FIG. 5;

FIG. 10 is a table demonstrating the calculation of differences in step S111 and the adjustment of differences in step S112 illustrated in FIG. 5;

DETAILED DESCRIPTION

An exemplary embodiment of the present invention will be described in detail hereinafter with reference to the accompanying drawings.

Figure 1:
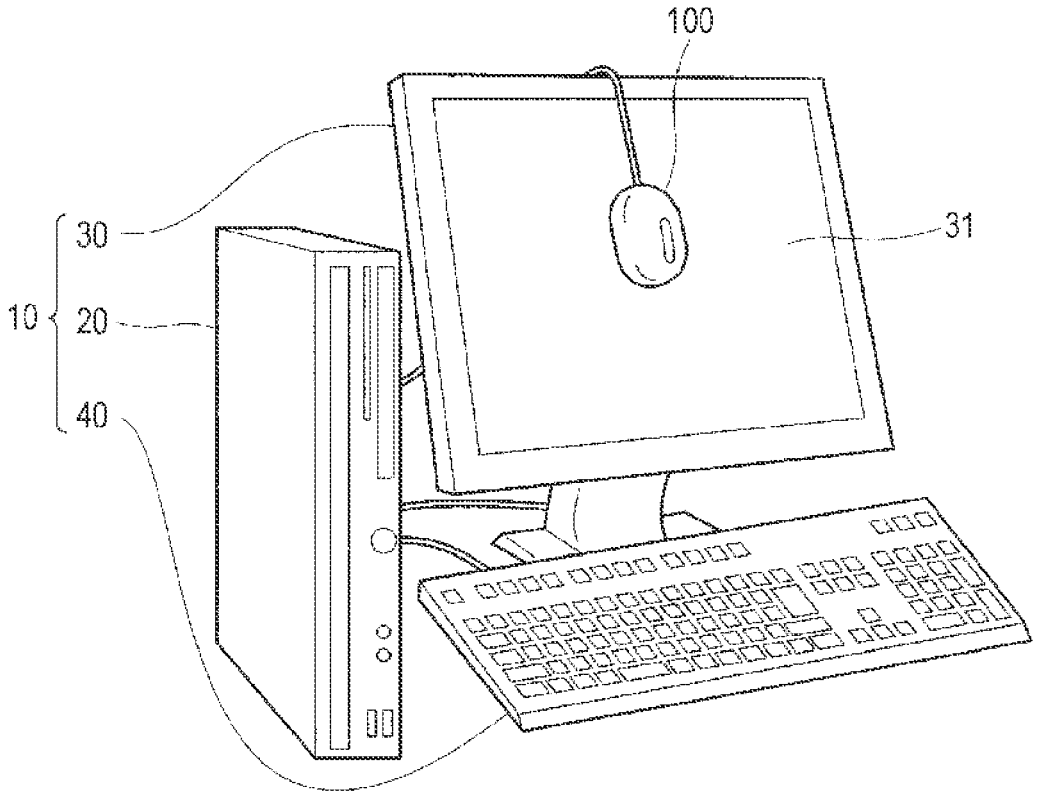
FIG. 1 illustrates an example configuration of an image display system according to an exemplary embodiment of the present invention.

FIG. 1 illustrates an example configuration of an image display system 10 according to this exemplary embodiment.

The image display system 10 includes a computer device 20 configured to perform processing such as creating image data for display, a display device 30 configured to display an image that is based on the image data created by the computer device 20 on a display screen 31, and an input device 40 configured to receive an input to the computer device 20 and the like.

In the image display system 10, the computer device 20 and the display device 30 are connected via Digital Visual Interface (DVI), and the computer device 20 and the input device 40 are connected via Universal Serial Bus (USB). The computer device 20 and the display device 30 may be connected via HDMI (High-Definition Multimedia Interface) (registered trademark) or DisplayPort instead of DVI.

The computer device 20 may be a general-purpose personal computer (PC). The computer device 20 is configured to perform processing such as creating image data by causing various pieces of application software to operate under the management of an operating system (OS).

The display device 30 may be a device having a function to display an image using an additive technique, such as a liquid crystal display for a PC, a liquid crystal television display, or a projector. Thus, the display method of the display device 30 is not limited to a liquid crystal method. In FIG. 1, by way of example, the display device 30 is a liquid crystal display for a PC, and the display device 30 has the display screen 31. For example, in a case where the display device 30 is a projector, the display screen 31 may be a screen provided outside the display device 30 or the like.

Examples of the input device 40 include a keyboard device illustrated in FIG. 1, and a mouse device (not illustrated).

In the image display system 10, for example, an image that is based on image data created using the input device 40 and the computer device 20 is displayed on the display screen 31 of the display device 30. Product design or the like with application software operating on the computer device 20 may require accurate color display of images on the display screen 31 of the display device 30. To this end, the image display system 10 is configured to execute a color matching operation for calibrating colors of an image to be displayed on the display screen 31 of the display device 30. The color matching operation according to this exemplary embodiment includes a hardware color matching operation and a software color matching operation. The hardware color matching operation is an operation for performing color adjustment to adjust the color temperature and brightness of the display device 30 to the target levels by changing hardware settings. The software color matching operation is an operation for constructing a color conversion profile, which is used in color conversion processing performed by the computer device 20, in accordance with the device characteristics of the display device 30. The color conversion profile may be used, when color conversion processing is performed, in a video card of the computer device 20, an OS, or an application used in the computer device 20.

In FIG. 1, a color measurement device 100, which is used in the color matching operation, is also illustrated along with the image display system 10. The color measurement device 100 may be utilized to read an image displayed on the display screen 31 of the display device 30 (i.e., to measure the device characteristics).

Figure 2:
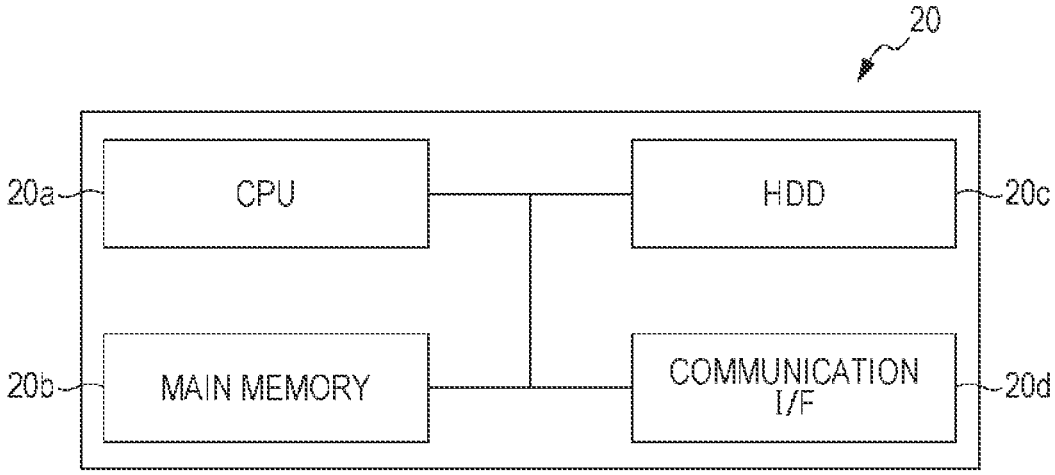
FIG. 2 illustrates a hardware configuration of a computer device.

FIG. 2 illustrates a hardware configuration of the computer device 20.

As described above, the computer device 20 may be implemented as a personal computer or the like. The computer device 20 includes a central processing unit (CPU) 20*a*, a main memory 20*b*, and a hard disk drive (HDD) 20*c*. The CPU 20*a* serves as a calculation unit, and the main memory 20*b* and the HDD 20*c* each serve as a memory. The CPU 20*a* executes various programs such as an OS and application software. The main memory 20*b* may be a storage area for storing various programs, data used for the execution of the programs, and so forth. The HDD 20*c* may be a storage area for storing input data to the various programs, output data from the various programs, and so forth. The computer device 20 further includes a communication interface (I/F) 20*d* configured to communicate with external devices including the input device 40 and the display device 30.

The programs may be provided in the form of being stored in the HDD 20*c* in advance, and may be loaded into the main memory 20*b*. The programs may also be transmitted to the computer device 20 via a network such as the Internet, installed into the HDD 20*c* via the communication I/F 20*d*, and loaded into the main memory 20*b*. The programs may also be loaded into the main memory 20*b* from an external recording medium such as a digital versatile disc read-only memory (DVD-ROM) or a flash memory.

Figure 3:
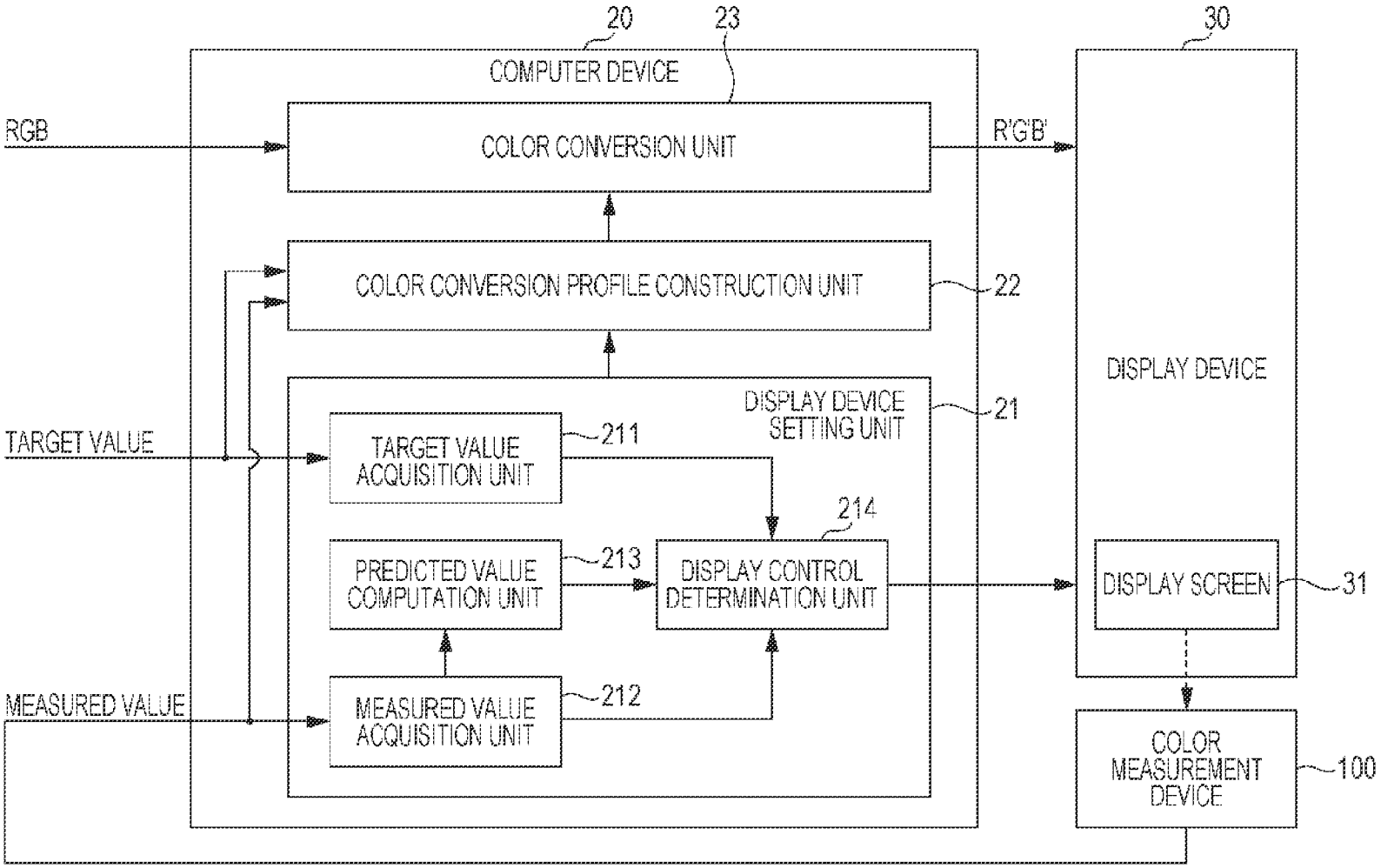
FIG. 3 illustrates an example functional configuration of the computer device.

FIG. 3 illustrates an example functional configuration of the computer device 20 according to this exemplary embodiment.

The computer device 20 includes a display device setting unit 21, a color conversion profile construction unit 22, and a color conversion unit 23. The display device setting unit 21 sets the display condition of the display device 30. The color conversion profile construction unit 22 constructs a color conversion profile, which is used for color conversion, by using the display condition set by the display device setting unit 21, a target value, and measured values. The target value and the measured values will be described below. The color conversion unit 23 performs color conversion processing on color (red, green, and blue (RGB)) signals input from the outside using the color conversion profile constructed by the color conversion profile construction unit 22, and outputs the converted color (R'G'B') signals to the display device 30.

The display device setting unit 21 includes a target value acquisition unit 211, a measured value acquisition unit 212, a predicted value computation unit 213, and a display condition determination unit 214. The target value acquisition unit 211 acquires a target value for the display device 30 in hardware color matching, which is input via the input device 40 (see FIG. 1) or the like. The measured value acquisition unit 212 acquires a measured value obtained as a result of reading an image displayed on the display screen 31 using the color measurement device 100. The predicted value computation unit 213 computes a predicted value on the basis of the measured value acquired by the measured value acquisition unit 212. The display condition determination unit 214 determines the display condition (setting value) of the display device 30 on the basis of the target value acquired by the target value acquisition unit 211, the measured value acquired by the measured value acquisition unit 212, and the predicted value computed by the predicted value computation unit 213. The target value, the measured value, and the predicted value each include a value relating to the color temperature (color temperature value) and a value relating to the brightness (brightness value). That is, the target value includes a target color temperature value and a target brightness value, and the measured value includes a measured color temperature value and a measured brightness value. The predicted value includes a predicted color temperature value and a predicted brightness value. The display condition (setting value) also includes a color temperature value and a brightness value.

In this exemplary embodiment, the target value acquisition unit 211 serves as a target value obtainer, the measured value acquisition unit 212 as a measured value obtainer, the predicted value computation unit 213 as a predictor, and the display condition determination unit 214 as a determiner. In addition, the color conversion unit 23 serves as a color converter.

FIG. 4 illustrates a list of display settings for the display device 30 according to this exemplary embodiment. In the display device 30, when an image is to be displayed, the settings of color temperature and brightness are not consecutively changed but are discretely set. In this exemplary embodiment, the color temperature may be set to five levels ("low", "intermediate-low", "intermediate", "intermediate-high", and "high"), and the brightness may be set to three levels ("dark", "intermediate", and "bright"). The combination of the respective levels of color temperature and brightness may provide 15 display settings in total. The display condition determination unit 214 selects one of the 15 display settings as a display condition.

In the following description, the combination of the low level of color temperature and the dark level of brightness is referred to as a first setting Set1, the combination of the intermediate-low level of color temperature and the dark level of brightness is referred to as a second setting Set2, the combination of the intermediate level of color temperature and the dark level of brightness is referred to as a third setting Set3, the combination of the intermediate-high level of color temperature and the dark level of brightness is referred to as a fourth setting Set4, and the combination of the high level of color temperature and the dark level of brightness is referred to as a fifth setting Set5. In addition, the combination of the low level of color temperature and the intermediate level of brightness is referred to as a sixth setting Set6, the combination of the intermediate-low level of color temperature and the intermediate level of brightness is referred to as a seventh setting Set7, the combination of the intermediate level of color temperature and the intermediate level of brightness is referred to as an eighth setting Set8, the combination of the intermediate-high level of color temperature and the intermediate level of brightness is referred to as a ninth setting Set9, and the combination of the high level of color temperature and the intermediate level of brightness is referred to as a tenth setting Set10. In addition, the combination of the low level of color temperature and the bright level of brightness is referred to as an eleventh setting Set11, the combination of the intermediate-low level of color temperature and the bright level of brightness is referred to as a twelfth setting Set12, the combination of the intermediate level of color temperature and the bright level of brightness is referred to as a thirteenth setting Set13, the combination of the intermediate-high level of color temperature and the bright level of brightness is referred to as a fourteenth setting Set14, and the combination of the high level of color temperature and the bright level of brightness is referred to as a fifteenth setting Set15.

The color matching operation of the display device 30 in the image display system 10 according to this exemplary embodiment will now be described in detail.

Figure 5:
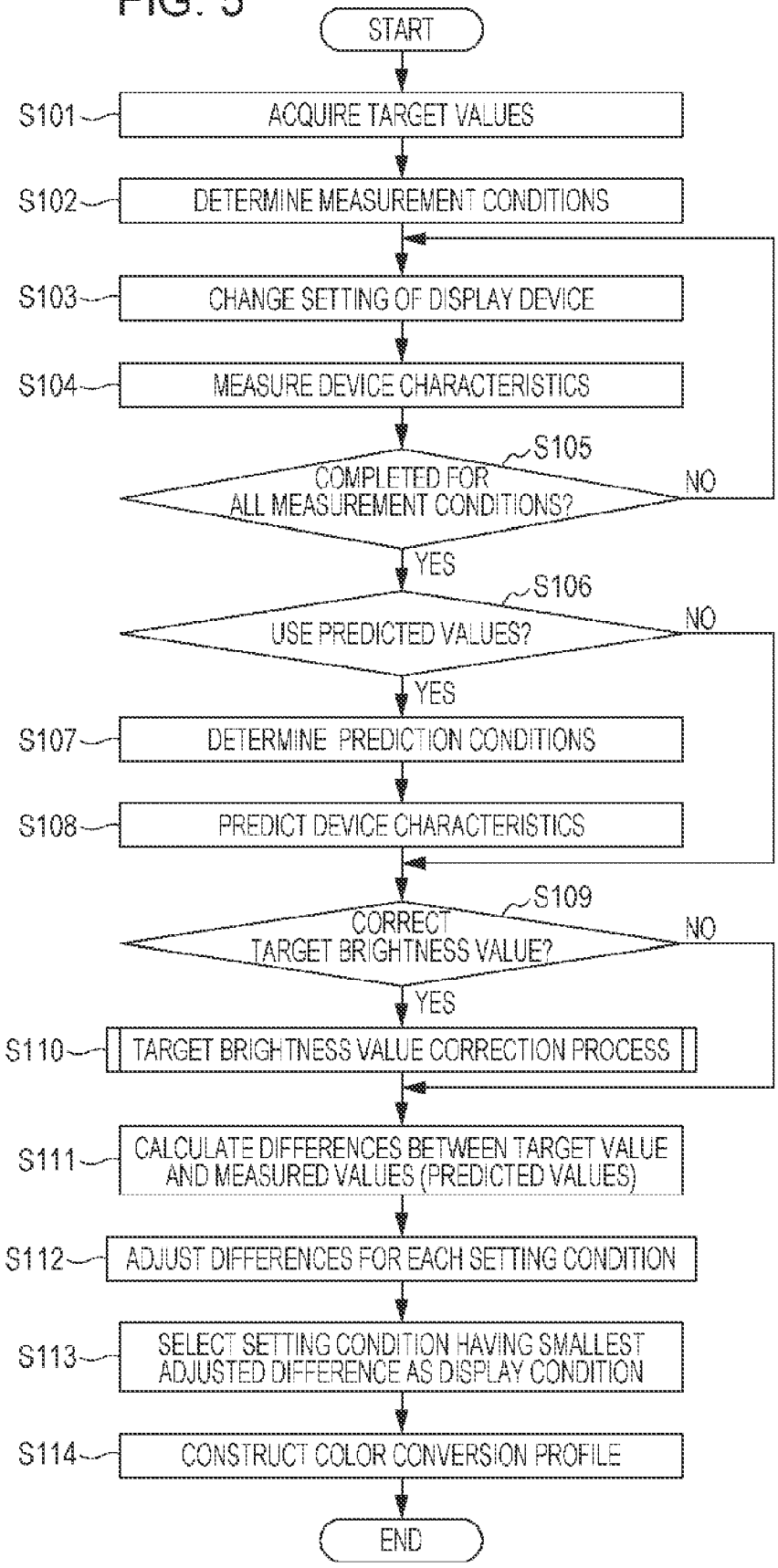
FIG. 5 is a flowchart illustrating a processing procedure for a color matching operation of the display device.

FIG. 5 is a flowchart illustrating a processing procedure for the color matching operation of the display device 30.

In the illustrated process, first, the target value acquisition unit 211 included in the display device setting unit 21 of the computer device 20 acquires target values (a target color temperature value and a target brightness value) (step S101). Then, the display condition determination unit 214 included in the display device setting unit 21 of the computer device 20 determines the measurement conditions of the display device 30 in the hardware color matching operation on the basis of the target values acquired in step S101 in accordance with an instruction received via the input device 40 or the like (step S102). In step S102, multiple (two or more and 15 or less) settings out of the 15 display settings illustrated in FIG. 4 are selected as measurement conditions.

Then, the display condition determination unit 214 selects one of the multiple measurement conditions (display settings) determined in step S102, and changes the display setting of the display device 30 to the selected measurement condition (step S103). Then, the device characteristics of the display device 30 (the display screen 31) are measured using the color measurement device 100 under the measurement condition (display setting) set in step S103 (step S104). In step S104, accordingly, measured values (a measured color temperature value and a measured brightness value) are acquired for one measurement condition by using the color measurement device 100. The measured values acquired by the color measurement device 100 are output to the measured value acquisition unit 212 included in the display device setting unit 21 of the computer device 20.

Then, the display condition determination unit 214 determines whether device characteristics have been acquired for all the measurement conditions determined in step S102 (step S105). If a negative determination (NO) is made in step S105, the process returns to step S103, in which the display condition determination unit 214 continues to acquire the device characteristics under the other measurement conditions.

If a positive determination (YES) is made in step S105, the display condition determination unit 214 determines whether the input device 40 or the like has received an instruction to use predicted values (step S106).

If a positive determination (YES) is made in step S106, the predicted value computation unit 213 determines the remaining display settings, which have not been selected as measurement conditions in step S102, among the 15 display settings illustrated in FIG. 4 as prediction conditions (step S107). Then, the predicted value computation unit 213 predicts the device characteristics of the display device 30 (the display screen 31) in the respective prediction conditions using the multiple measured values acquired in step S104 (step S108). Then, the process proceeds to step S109 described below. In step S108, therefore, predicted values (predicted color temperature value and predicted brightness value) for each of the prediction conditions are computed. If a negative determination (NO) is made in step S106, the process proceeds to step S109 without the computation of predicted values.

Then, the display condition determination unit 214 determines whether the input device 40 or the like has received an instruction to correct the target brightness value among the target values acquired in step S101 (step S109). If a positive determination (YES) is made in step S109, the display condition determination unit 214 executes a process for correcting the target brightness value (step S110). Then, the process proceeds to step S111, described below. If a negative determination (NO) is made in step S109, the process proceeds to step S111 without the correction of the target brightness value.

Then, the display condition determination unit 214 calculates the differences between the target values acquired in step S101 (or target values including the target brightness value corrected in step S110) and the multiple measured values acquired in step S104 (step S111). If predicted values are used, then in step S111, the display condition determination unit 214 also calculates the differences between the target values acquired in step S101 (or target values including the target brightness value corrected in step S110) and the one or multiple predicted values acquired in step S108.

Then, the display condition determination unit 214 adjusts the multiple differences determined in step S111 by adjusting the differences for each setting condition (step S112) to obtain multiple adjusted differences. Then, the display condition determination unit 214 selects a setting condition (one of the first setting Set1 to the fifteenth setting Set15) corresponding to the smallest adjusted difference among the multiple adjusted differences obtained in step S112, as a display condition of the display device 30 (step S113).

Then, the color conversion profile construction unit 22 constructs a color conversion profile to be used by the color conversion unit 23, on the basis of the target values, measured values (predicted values), and display conditions acquired from the display device setting unit 21 (step S114). Then, the color matching operation is completed.

In the processing procedure for the color matching operation illustrated in FIG. 5, steps S101 to S113 correspond to the hardware color matching operation, and step S114 corresponds to the software color matching operation.

Figure 6:
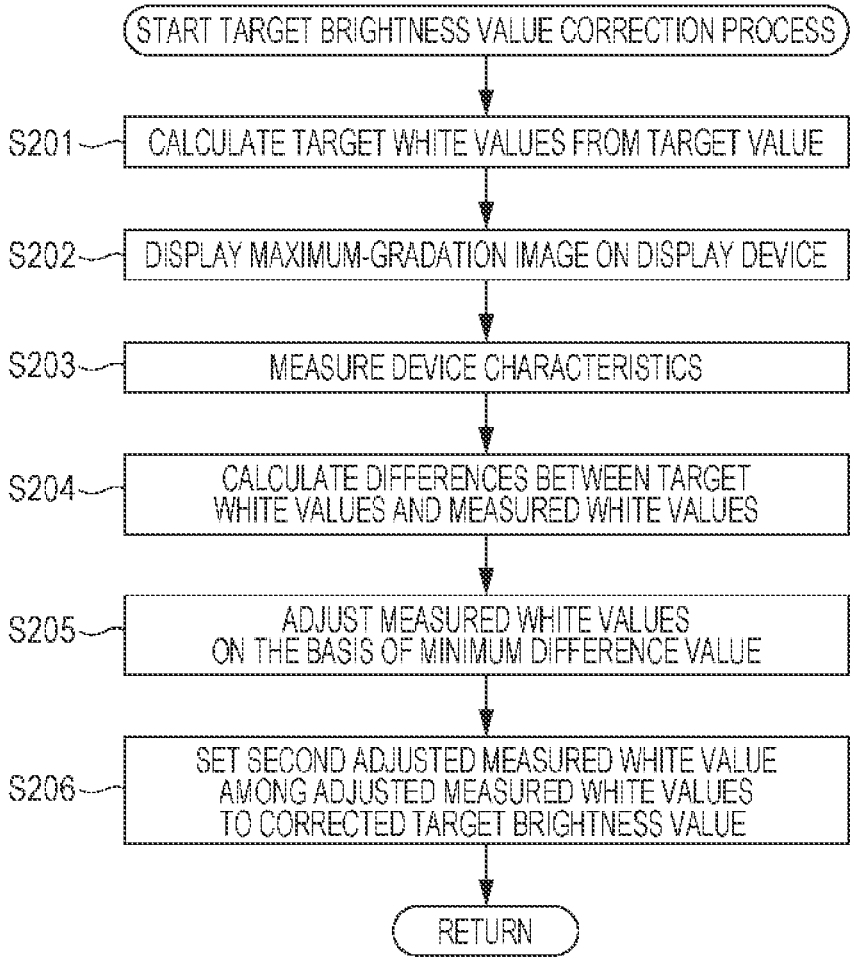
FIG. 6 is a flowchart illustrating a processing procedure for a target brightness value correction process.

FIG. 6 is a flowchart illustrating a processing procedure for the target brightness value correction process illustrated in step S110 of FIG. 5.

In the illustrated process, first, the display condition determination unit 214 calculates target white values from the target values acquired in step S101 (step S201). Then, the display condition determination unit 214 displays a maximum-gradation image (or white image) on the display screen 31 of the display device 30 (step S202). The maximum-gradation image (white image) is an image having the highest gradation level of each of the RGB colors. Then, the device characteristics of the display device 30 (the display screen 31) are measured for the maximum-gradation image (white image) displayed in step S202 using the color measurement device 100 (step S203). Accordingly, in step S203, measured values (referred to as "measured white values") when the maximum-gradation image (white image) is displayed are acquired by the color measurement device 100. The measured white values acquired by the color measurement device 100 are output to the measured value acquisition unit 212.

Then, the display condition determination unit 214 calculates the differences (referred to as "white differences") between the target white values calculated in step S201 and the measured white values acquired in step S203 (step S204). Then, the display condition determination unit 214 adjusts the measured white values in accordance with the white difference having the smallest value among the white differences obtained in step S204 (step S205), and obtains adjusted measured white values. Then, the display condition determination unit 214 sets second adjusted measured white values (described in detail below) among the obtained adjusted measured white values as corrected target brightness values (step S206). Then, the process ends.

The details of the processes in the color matching operation described above (more specifically, the hardware color matching operation) will now be described using a specific example. It is assumed here that in target values T acquired in step S101, a target color temperature value Tt is 6500 K and a target brightness value Tb is 100 cd/m$^2$.

FIG. 7 illustrates an example of the measured values M acquired in step S104 illustrated in FIG. 5. In the illustrated example, the measured values M obtained in step S104 include measured color temperature values Mt, which are measured values of color temperature, and measured brightness values Mb, which are measured values of brightness. In FIG. 7, the measured values M, the measurement conditions (display settings) under which the measured values M were measured, and the measured color temperature values Mt and measured brightness values Mb in the measured values M are associated with one another.

It is assumed here that, out of the 15 display settings illustrated in FIG. 4, nine display settings (the first setting Set1, the third setting Set3, the fifth setting Set5, the sixth setting Set6, the eighth setting Set8, the tenth setting Set10, the eleventh setting Set11, the thirteenth setting Set13, and the fifteenth setting Set15) are selected as measurement conditions in step S102. In the example illustrated in FIG. 7, furthermore, among the measured values M, a measured value obtained with the first setting Set1 is referred to as a first measured value M1, a measured value obtained with the third setting Set3 is referred to as a second measured value M2, a measured value obtained with the fifth setting Set5 is referred to as a third measured value M3, a measured value obtained with the sixth setting Set6 is referred to as a fourth measured value M4, a measured value obtained with the eighth setting Set8 is referred to as a fifth measured value M5, a measured value obtained with the tenth setting Set10 is referred to as a sixth measured value M6, a measured value obtained with the eleventh setting Set11 is referred to as a seventh measured value M7, a measured value obtained with the thirteenth setting Set13 is referred to as an eighth measured value M8, and a measured value obtained with the fifteenth setting Set15 is referred to as a ninth measured value M9. The first measured value M1 includes a first measured color temperature value Mt1 and a first measured brightness value Mb1, the second measured value M2 includes a second measured color temperature value Mt2 and a second measured brightness value Mb2, the third measured value M3 includes a third measured color temperature value Mt3 and a third measured brightness value Mb3, the fourth measured value M4 includes a fourth measured color temperature value Mt4 and a fourth measured brightness value Mb4, the fifth measured value M5 includes a fifth measured color temperature value Mt5 and a fifth measured brightness value Mb5, the sixth measured value M6 includes a sixth measured color temperature value Mt6 and a sixth measured brightness value Mb6, the seventh measured value M7 includes a seventh measured color temperature value Mt7 and a seventh measured brightness value Mb7, the eighth measured value M8 includes an eighth measured color temperature value Mt8 and an eighth measured brightness value Mb8, and the ninth measured value M9 includes a ninth measured color temperature value Mt9 and a ninth measured brightness value Mb9.

In the first measured value M1, by way of example, the first measured color temperature value Mt1 is 4500 K and the first measured brightness value Mb1 is 70 cd/m$^2$. In the second measured value M2, by way of example, the second measured color temperature value Mt2 is 5500 K and the second measured brightness value Mb2 is 110 cd/m$^2$. In the third measured value M3, by way of example, the third measured color temperature value Mt3 is 8000 K and the third measured brightness value Mb3 is 130 cd/m$^2$. In the fourth measured value M4, by way of example, the fourth measured color temperature value Mt4 is 4800 K and the fourth measured brightness value Mb4 is 100 cd/m$^2$. In the fifth measured value M5, by way of example, the fifth measured color temperature value Mt5 is 6500 K and the fifth measured brightness value Mb5 is 120 cd/m$^2$. In the sixth measured value M6, by way of example, the sixth measured color temperature value Mt6 is 9000 K and the sixth measured brightness value Mb6 is 150 cd/m$^2$. In the seventh measured value M7, by way of example, the seventh measured color temperature value Mt7 is 5000 K and the seventh measured brightness value Mb7 is 170 cd/m$^2$. In the eighth measured value M8, by way of example, the eighth measured color temperature value Mt8 is 7000 K and the eighth measured brightness value Mb8 is 190 cd/m$^2$. In the ninth measured value M9, by way of example, the ninth measured color temperature value Mt9 is 10000 K and the ninth measured brightness value Mb9 is 200 cd/m$^2$.

FIG. 8 illustrates an example of the predicted values P predicted in step S108 illustrated in FIG. 5. In the illustrated example, the predicted values P obtained in step S108 include predicted color temperature values Pt, which are predicted values of color temperature, and predicted brightness values Pb, which are predicted values of brightness. In FIG. 8, the predicted values P, the prediction conditions (display settings) under which the predicted values P were predicted, and the predicted color temperature values Pt and predicted brightness values Pb in the predicted values P are associated with one another.

It is assumed here that, out of the 15 display settings illustrated in FIG. 4, the remaining display settings, except for those selected as measurement conditions in step S102, that is, six display settings (the second setting Set2, the fourth setting Set4, the seventh setting Set7, the ninth setting Set9, the twelfth setting Set12, and the fourteenth setting Set14) are selected as prediction conditions. In the example illustrated in FIG. 8, furthermore, among the predicted values P, a predicted value obtained with the second setting Set2 is referred to as a first predicted value P1, a predicted value obtained with the fourth setting Set4 is referred to as a second predicted value P2, a predicted value obtained with the seventh setting Set7 is referred to as a third predicted value P3, a predicted value obtained with the ninth setting Set9 is referred to as a fourth predicted value P4, a predicted value obtained with the twelfth setting Set12 is referred to as a fifth predicted value P5, and a predicted value obtained with the fourteenth setting Set14 is referred to as a sixth predicted value P6. The first predicted value P1 includes a first predicted color temperature value Pt1 and a first predicted brightness value Pb1, the second predicted value P2 includes a second predicted color temperature value Pt2 and a second predicted brightness value Pb2, the third predicted value P3 includes a third predicted color temperature value Pt3 and a third predicted brightness value Pb3, the fourth predicted value P4 includes a fourth predicted color temperature value Pt4 and a fourth predicted brightness value Pb4, the fifth predicted value P5 includes a fifth predicted color temperature value Pt5 and a fifth predicted brightness value Pb5, and the sixth predicted value P6 includes a sixth predicted color temperature value Pt6 and a sixth predicted brightness value Pb6.

In the first predicted value P1, by way of example, the first predicted color temperature value Pt1 is 5000 K and the first predicted brightness value Pb1 is 90 cd/m$^2$. In the second predicted value P2, by way of example, the second predicted color temperature value Pt2 is 6800 K and the second predicted brightness value Pb2 is 125 cd/m$^2$. In the third predicted value P3, by way of example, the third predicted color temperature value Pt3 is 5500 K and the third predicted brightness value Pb3 is 110 cd/m$^2$. In the fourth predicted value P4, by way of example, the fourth predicted color temperature value Pt4 is 7800 K and the fourth predicted brightness value Pb4 is 135 cd/m$^2$. In the fifth predicted value P5, by way of example, the fifth predicted color temperature value Pt5 is 6000 K and the fifth predicted brightness value Pb5 is 180 cd/m$^2$. In the sixth predicted value P6, by way of example, the sixth predicted color temperature value Pt6 is 8500 K and the sixth predicted brightness value Pb6 is 195 cd/m$^2$.

Figure 9:
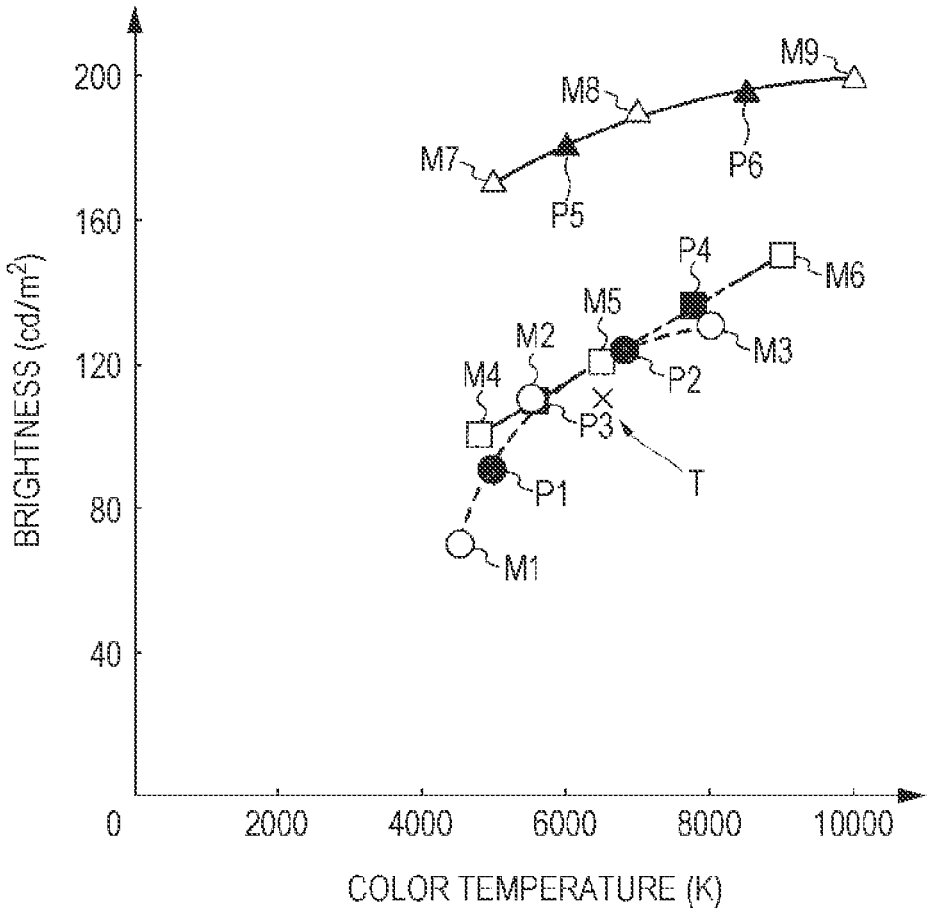
FIG. 9 is a graph demonstrating a method for calculating predicted values in step S108 illustrated in FIG. 5.

FIG. 9 demonstrates a method for calculating predicted values in step S108 illustrated in FIG. 5. FIG. 9 illustrates relationships between the measured values M (the first measured value M1 to the ninth measured value M9) and the predicted values P (the first predicted value P1 to the sixth predicted value P6), where color temperature (K) is plotted on the horizontal axis and brightness (cd/m$^2$) is plotted on the vertical axis. In FIG. 9, the target values T are also illustrated for reference in addition to the measured values M and the predicted values P.

In this exemplary embodiment, the predicted values P, namely, the first predicted value P1 to the sixth predicted value P6, are predicted on the basis of the measured values M, namely, the first measured value M1 to the ninth measured value M9. For example, the first predicted value P1 and the second predicted value P2 may be determined using the first measured value M1, the second measured value M2, and the third measured value M3, which are common in that the brightness is in the dark level in the display settings illustrated in FIG. 4, by performing computation using an existing interpolation method (for example, Lagrange's interpolation or spline interpolation). For example, the third predicted value P3 and the fourth predicted value P4 may be determined using the fourth measured value M4, the fifth measured value M5, and the sixth measured value M6, which are common in that the brightness is in the intermediate level in the display settings illustrated in FIG. 4, by performing computation using the interpolation method described above. For example, the fifth predicted value P5 and the sixth predicted value P6 may be determined using the seventh measured value M7, the eighth measured value M8, and the ninth measured value M9, which are common in that the brightness is in the bright level in the display settings illustrated in FIG. 4, by performing computation using the interpolation method described above.

As may be seen from FIG. 9, in the illustrated example, there is no measured value M or predicted value P that matches the target color temperature value Tt or the target brightness value Tb in the target value T.

FIG. 10 demonstrates the calculation of differences in step S111 illustrated in FIG. 5 and the adjustment of the differences in step S112. In FIG. 10, the measurement conditions (or prediction conditions), the measured values M (or predicted values P), items relating to color temperature, items relating to brightness, and adjusted differences Da are associated with one another. In FIG. 10, the items relating to color temperature include the target color temperature value Tt, the measured color temperature values Mt (or the predicted color temperature values Pt), color temperature differences Dt between the target color temperature value Tt and the measured color temperature values Mt (or the predicted color temperature values Pt), color temperature weighting factors Wt determined on the basis of the values of color temperature, and adjusted color temperature differences Dat obtained by multiplying the color temperature differences Dt by the color temperature weighting factors Wt. In FIG. 10, the items relating to brightness include the target brightness value Tb, the measured brightness values Mb (or the predicted brightness values Pb), brightness differences Db between the target brightness value Tb and the measured brightness values Mb (or the predicted brightness values Pb), brightness weighting factors Wb determined on the basis of the values of brightness, and adjusted brightness differences Dab obtained by multiplying the brightness differences Db by the brightness weighting factors Wb. The adjusted differences Da described above are represented as sums of the adjusted color temperature differences Dat and the adjusted brightness differences Dab.

Figure 11A:
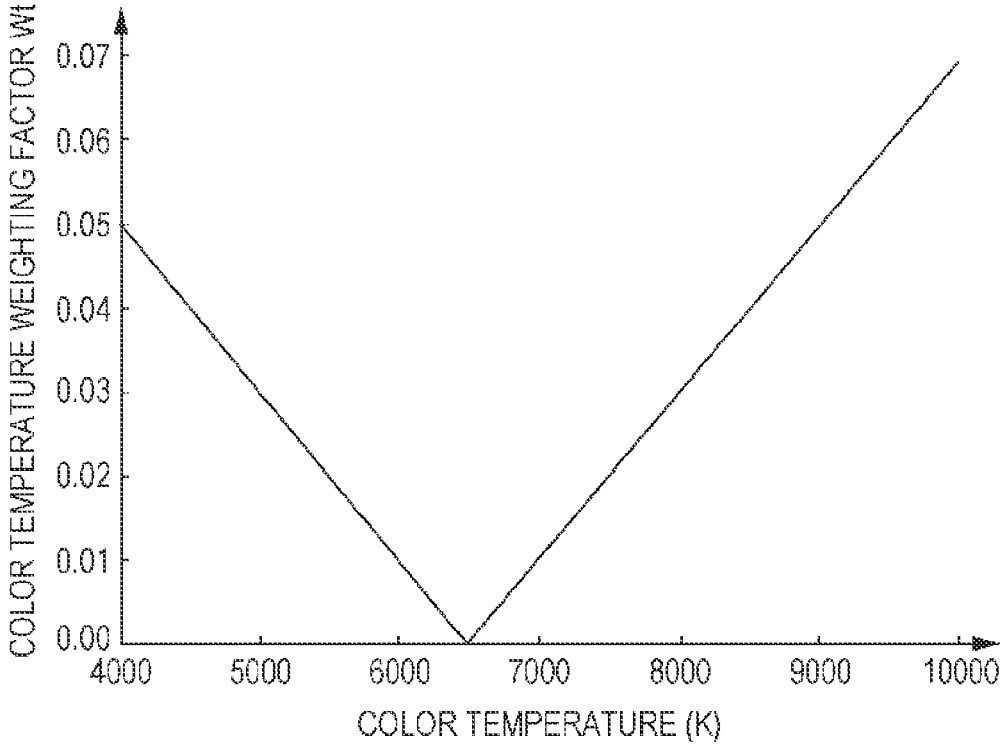
FIGS. 11A and 11B illustrate a color temperature weighting factor and a brightness weighting factor, respectively.
Figure 11B:
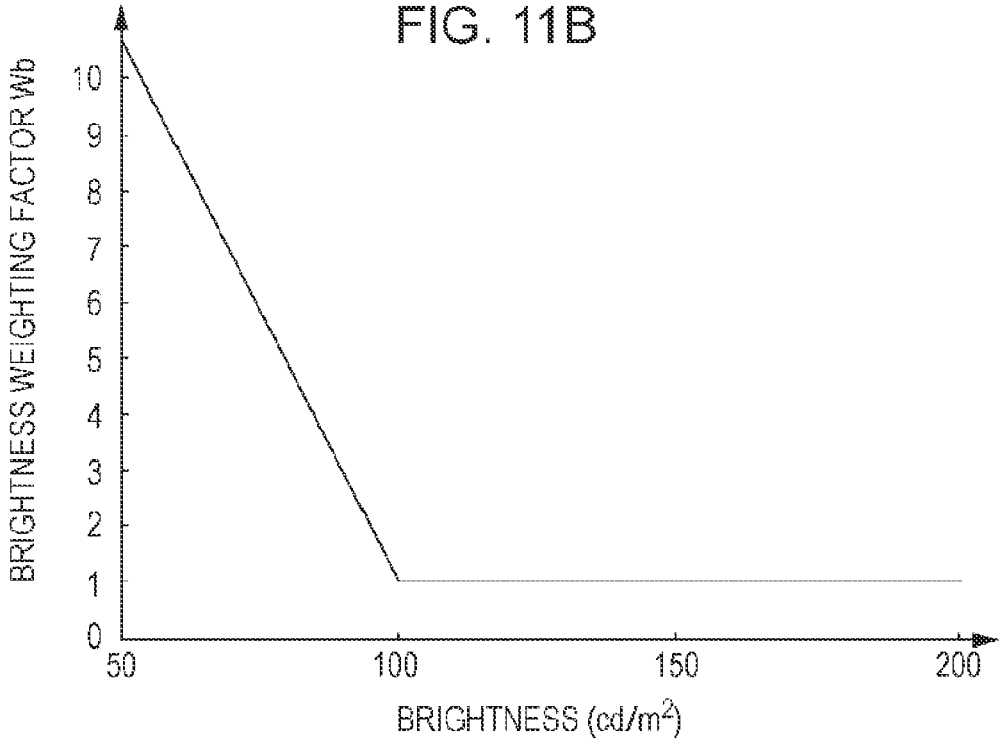

FIGS. 11A and 11B illustrate the color temperature weighting factors Wt and brightness weighting factors Wb illustrated in FIG. 10, respectively.

In FIG. 11A, the horizontal axis represents color temperature (K) and the vertical axis represents color temperature weighting factor Wt. In the illustrated example, the color temperature weighting factor Wt is 0 when the value of the color temperature is equal to the target color temperature value Tt (in the illustrated example, 6500 K), and the color temperature weighting factor Wt linearly increases as the value of the color temperature shifts upward or downward from the target color temperature value Tt.

In FIG. 11B, the horizontal axis represents brightness (cd/m$^2$) and the vertical axis represents brightness weighting factor Wb. In the illustrated example, the brightness weighting factor Wb is 1 when the value of the brightness is greater than or equal to the target brightness value Tb (in the illustrated example, 100 cd/m$^2$), and the brightness weighting factor Wb linearly increases as the value of the brightness shifts upward or downward from the target brightness value Tb.

In the illustrated example, as illustrated in FIG. 10, the value (=20) of the adjusted difference Da in the eighth setting Set8 among the 15 display settings (the nine measurement conditions and the six prediction conditions) is smaller than the values of the adjusted differences Da in the other settings, namely, the first setting Set1 to the seventh setting Set7 and the ninth setting Set9 to the fifteenth setting Set15. In step S113 illustrated in FIG. 5, accordingly, the eighth setting Set8 is selected as a setting condition.

Referring to FIG. 9, it may be found that the fifth measured value M5 obtained in the eighth setting Set8 (the fifth measured color temperature value Mt5=6500 K and the fifth measured brightness value Mb5=120 cd/m$^2$) is close to the target values T (the target color temperature value Tt=6500 K and the target brightness value Tb=100 cd/m$^2$). Thus, determining a display condition of the display device 30 using the method described above allows the obtainment of a display condition of the display device 30 which is closer to the target value T. Constructing a color conversion profile while keeping the display condition of the display device 30 close to the target values T may prevent or reduce any defect or inconvenience such as loss of gradation in the color signals after color conversion has been performed, resulting in an image being displayed on a display screen of the display device 30 with more accurate colors.

In this exemplary embodiment, the color temperature weighting factors Wt are set symmetrical with respect to the target color temperature value Tt in the manner illustrated in FIG. 11A. In contrast, as illustrated in FIG. 11B, the brightness weighting factors Wb are set asymmetrical with respect to the target brightness value Tb. The reason for this is as follows.

In this exemplary embodiment, the computer device 20 constructs a color conversion profile by executing the hardware color matching operation to set the display condition of the display device 30 to an appropriate state and then executing the software color matching operation. In the process for constructing a color conversion profile, for example, the gradation curves for the respective RGB colors are set so as to obtain more accurate color reproduction in the set display condition. If the difference between the set display condition and the required target value increases, the errors included in the color conversion profile to be constructed will increase. An increase in errors may reduce the smoothness of gradation of an image whose colors have been converted using the color conversion profile, causing the colors of the image displayed on the display device 30 to deviate from the target ones.

In the construction of a color conversion profile, the brightness of an image displayed on the display device 30 may become lower than the brightness in the display settings. In order to avoid such an inconvenience, in this exemplary embodiment, the value of a brightness weighting factor Wb at a brightness value less than the target brightness value Tb is set higher than the value of a brightness weighting factor Wb at a brightness value greater than or equal to the target brightness value Tb so that a display setting having a brightness value lower than the target brightness value Tb may be less likely to be selected as a setting condition. Conversely, in this example, a display setting having a brightness value greater than or equal to the target brightness value Tb may be more likely to be selected as a setting condition.

In the construction of a color conversion profile, in contrast, the color temperature of an image displayed on the display device 30 does not generally become higher or lower than the color temperature in the display settings. Accordingly, in this exemplary embodiment, the value of a color temperature weighting factor Wt at a color temperature value more than or less than the target color temperature value Tt is set higher than the value of a color temperature weighting factor Wt at the target color temperature value Tt so that a display setting having a color temperature value higher or lower than the target color temperature value Tt may be less likely to be selected as a setting condition.

Figure 12:
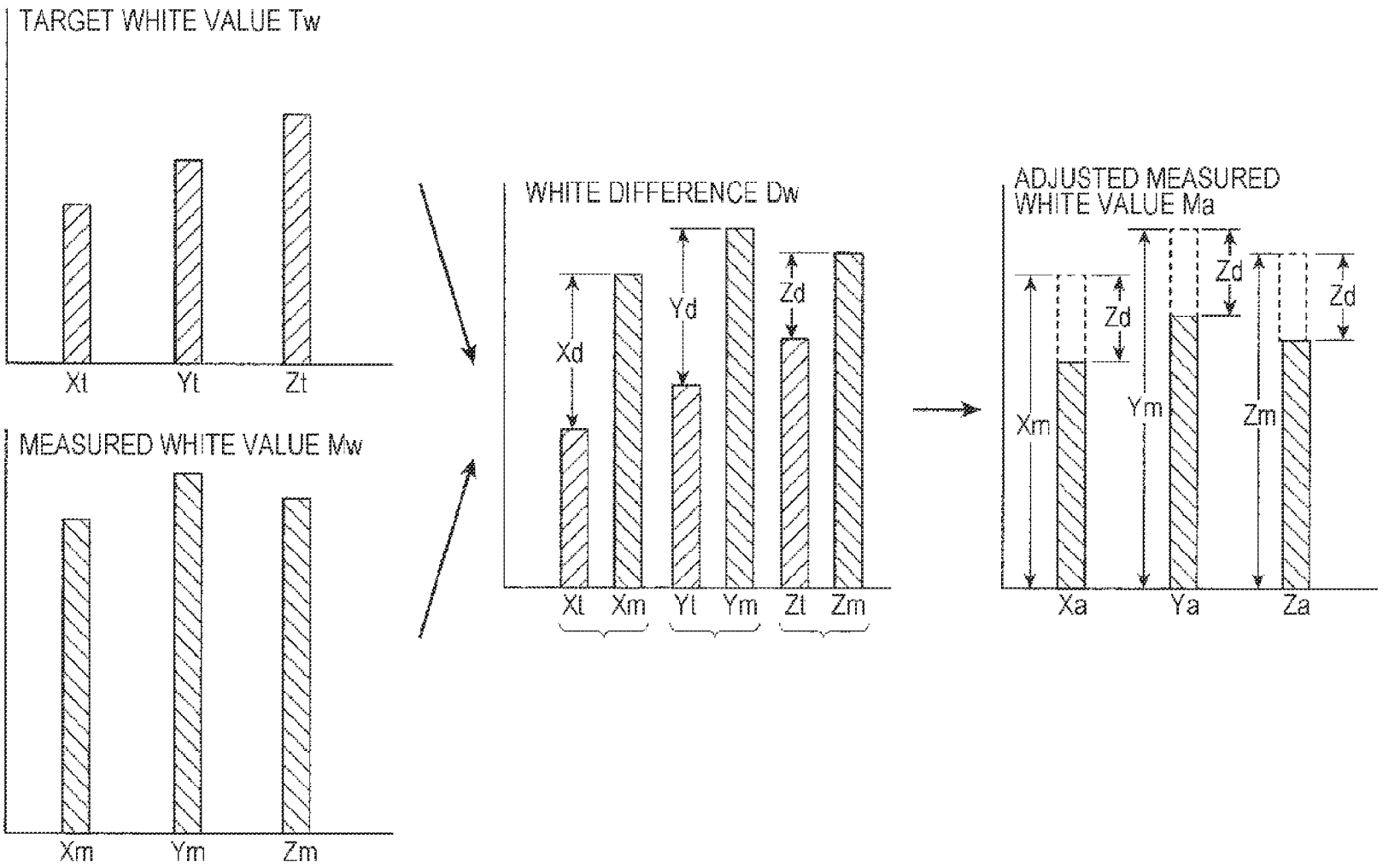
FIG. 12 illustrates an example of a procedure for the target brightness value correction process in step S110 illustrated in FIG. 5.

FIG. 12 illustrates an example of a procedure for step S110 illustrated in FIG. 5, that is, the target brightness value correction process illustrated in FIG. 6. In FIG. 12, target white values Tw calculated in step S201 are illustrated in the upper left part thereof, measured white values Mw measured in step S203 are illustrated in the lower left part thereof, white differences Dw calculated in step S204 are illustrated in the middle part thereof, and adjusted measured white values Ma obtained in step S205 are illustrated in the right part thereof.

First, in step S201, the target values T (the target color temperature value Tt and the target brightness value Tb) acquired in step S101 are subjected to color conversion into the XYZ color space to determine target white values Tw that are target values relating to white. The target white values Tw include a first target white value Xt serving as the X component, a second target white value Yt serving as the Y component, and a third target white value Zt serving as the Z component. In the illustrated example, the relationship Zt>Yt>Xt is established.

Then, in steps 202 and 203, an image (white image) with (R, G, B)=(255, 255, 255) is displayed on the display screen 31 of the display device 30 with the display setting selected in step S113 (see FIG. 5), and the result of reading the displayed white image using the color measurement device 100 is subjected to color conversion into the XYZ color space to obtain measured white values Mw. The measured white values Mw include a first measured white value Xm serving as the X component, a second measured white value Ym serving as the Y component, and a third measured white value Zm serving as the Z component. In the illustrated example, the relationship Ym>Zm>Xm is established.

Then, in step S204, white differences Dw that are differences between the target white values Tw and the measured white values Mw are determined respectively for the X component, the Y component, and the Z component. In the illustrated example, the target white values Tw and the measured white values Mw have the relationships Xm>Xt, Ym>Yt, and Zm>Zt. In the illustrated example, therefore, the first white difference Xd that is the difference for the X component satisfies Xd=Xm−Xt>0, the second white difference Yd that is the difference for the Y component satisfies Yd=Ym−Yt>0, and the third white difference Zd that is the difference for the Z component satisfies Zd=Zm−Zm>0. In other words, all of the first white difference Xd, the second white difference Yd, and the third white difference Zd of the white difference Dw have positive values over 0.

Then, in step S205, an adjusted measured white value Ma is obtained by subtracting the white difference having the smallest value among the first white difference Xd, the second white difference Yd, and the third white difference Zd from each of the first measured white value Xm, the second measured white value Ym, and the third measured white value Zm. In the illustrated example, the third white difference Zd is the smallest. Thus, the third white difference Zd is subtracted from each of the first measured white value Xm, the second measured white value Ym, and the third measured white value Zm to obtain adjusted measured white values Ma, namely, a first adjusted measured white value Xa (=Xm−Zd), a second adjusted measured white value Ya (=Ym−Zd) and a third adjusted measured white value Za (=Zm−Zd).

Then, in step S206, the second adjusted measured white value Ya in the obtained adjusted measured white values Ma is set to a corrected target brightness value Tbc which replaces the target brightness value Tb. Then, the target brightness value correction process ends.

Figure 13:
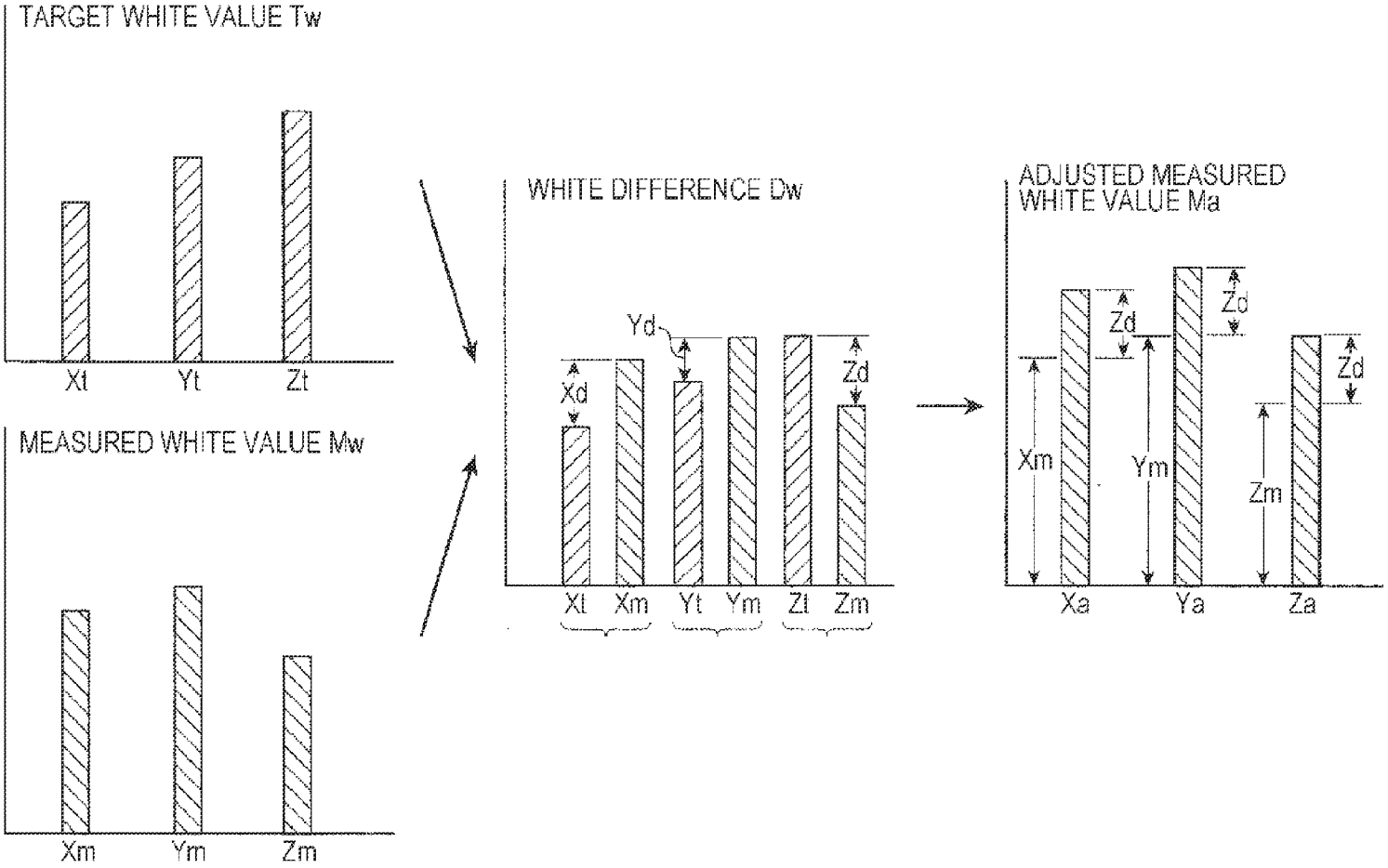
FIG. 13 illustrates another example of the procedure for the target brightness value correction process in step S110 illustrated in FIG. 5.

FIG. 13 illustrates another example of the procedure for the target brightness value correction process in step S110. In FIG. 13, target white values Tw calculated in step S201 are illustrated in the upper left part thereof, measured white values Mw measured in step S203 are illustrated in the lower left part thereof, white differences Dw calculated in step S204 are illustrated in the middle part thereof, and adjusted measured white values Ma obtained in step S205 are illustrated in the right part thereof.

First, in step S201, the target values T (the target color temperature value Tt and the target brightness value Tb) acquired in step S101 are subjected to color conversion into the XYZ color space to determine target white values Tw that are target values relating to white. The target white values Tw include a first target white value Xt serving as the X component, a second target white value Yt serving as the Y component, and a third target white value Zt serving as the Z component, and have the relationship Zt>Yt>Xt (which is the same as FIG. 12).

Then, in steps 202 and 203, an image (white image) with (R, G, B)=(255, 255, 255) is displayed on the display screen 31 of the display device 30 with the display setting selected in step S113 (see FIG. 5), and the result of reading the displayed white image using the color measurement device 100 is subjected to color conversion into the XYZ color space to obtain measured white values Mw. The measured white values Mw include a first measured white value Xm serving as the X component, a second measured white value Ym serving as the Y component, and a third measured white value Zm serving as the Z component. In the illustrated example, the relationship Ym>Xm>Zm is established (which is different from FIG. 12).

Then, in step S204, white differences Dw that are differences between the target white values Tw and the measured white values Mw are determined respectively for the X component, the Y component, and the Z component. In the illustrated example, the target white values Tw and the measured white values Mw have the relationships Xm>Xt, Ym>Yt, and Zm<Zt. In the illustrated example, therefore, the first white difference Xd that is the difference for the X component satisfies Xd=Xm−Xt>0, and the second white difference Yd that is the difference for the Y component satisfies Yd=Ym−Yt>0, whereas the third white difference Zd that is the difference for the Z component satisfies Zd=Zt−Zm<0. In other words, among the first white difference Xd, the second white difference Yd, and the third white difference Zd in the white differences Dw, the first white difference Xd and the second white difference Yd have positive values over 0 whereas the third white difference Zd has a negative value below 0.

Then, in step S205, adjusted measured white values Ma are obtained through addition using one of the first white difference Xd, the second white difference Yd, and the third white difference Zd in the white differences Dw that has the smallest value. In the illustrated example, since the third white difference Zd is the smallest, the third white difference Zd is added to each of the first measured white value Xm, the second measured white value Ym, and the third measured white value Zm to obtain adjusted measured white values Ma, namely, a first adjusted measured white value Xa (=Xm+Zd), a second adjusted measured white value Ya (=Ym+Zd) and a third adjusted measured white value Za (=Zm+Zd).

Then, in step S206, the second adjusted measured white value Ya in the obtained adjusted measured white values Ma is set to a corrected target brightness value Tbc which replaces the target brightness value Tb. Then, the target brightness value correction process ends.

In the illustrated example, the second adjusted measured white value Ya is set to the corrected target brightness value Tbc which replaces the target brightness value Tb because the Y component in the XYZ color space represents brightness.

In this way, in a case where the target brightness value correction process illustrated in FIG. 6 (the process of replacing the target brightness value Tb with the corrected target brightness value Tbc) is executed, a display condition is set using the corrected target brightness value Tbc. This may prevent or minimize the reduction in brightness, which is caused by the correction of color temperature, when a color conversion profile is constructed.

In this exemplary embodiment, by way of example but not limited to, color temperature and brightness are used for target values, measured values, predicted values, and display conditions. Any other settings may be used.

In this exemplary embodiment, furthermore, color temperature weighting factors Wt and brightness weighting factors Wb are determined using, but not limited to, the conditions illustrated in FIGS. 11A and 11B. A different determination method may be used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An apparatus for setting a display device, comprising:

a target value obtainer configured to acquire a target value of a display setting including color temperature and brightness for a display device configured to display an image;

a measured value obtainer configured to acquire a measured value of display characteristics including the color temperature and the brightness in each of a plurality of preset states specific to the display device, from the display device for which the display setting is sequentially changed to the plurality of preset states; and a determiner configured to determine a setting value in the display setting including the color temperature and the brightness from among the plurality of preset states, on the basis of the target value and a plurality of the measured values acquired in each of the plurality of preset states by the measured value obtainer.

2. The apparatus according to claim 1, further comprising:

a predictor configured to predict a predicted value in display characteristics including the color temperature and the brightness in another state specific to the display device, on the basis of the plurality of measured values, wherein the determiner is further configured to determine the setting value on the basis of the target value, the plurality of measured values, and the predicted value from among the plurality of preset states and the other state.

3. The apparatus according to claim 2, wherein the determiner is further configured to replace the determined setting value with the target value.

4. The apparatus according to claim 3, further comprising:

a color converter configured to perform color conversion processing on a color signal input from an external device in accordance with the setting value, and output the color signal to the display device, wherein the determiner is further configured to determine the setting value by taking into account the color conversion processing performed by the color converter.

5. The apparatus according to claim 2, further comprising:

a color converter configured to perform color conversion processing on a color signal input from an external device in accordance with the setting value, and output the color signal to the display device, wherein the determiner is further configured to perform the setting value by taking into account the color conversion processing performed by the color converter.

6. The apparatus according to claim 1, wherein the determiner is further configured to replace the determined setting value with the target value.

7. The apparatus according to claim 6, further comprising:

a color converter configured to perform color conversion processing on a color signal input from an external device in accordance with the setting value, and output the color signal to the display device, wherein the determiner is further configured to determine the setting value by taking into account the color conversion processing performed by the color converter.

8. The apparatus according to claim 1, further comprising:

a color converter configured to perform color conversion processing on a color signal input from an external device in accordance with the setting value, and output the color signal to the display device, wherein the determiner is further configured to determine the setting value by taking into account the color conversion processing performed by the color converter.

9. The apparatus according to claim 1, wherein each of the plurality of preset states comprises a preset brightness level and a preset color temperature level.

10. The apparatus according to claim 1, wherein each of the plurality of present states comprises a preset brightness level selected from a plurality of preset brightness levels specific to the display device and a preset color temperature level selected from a plurality of preset color temperature levels specific to the display device.

11. The apparatus according to claim 1, wherein the plurality of preset states comprises at least three states, and wherein each of the at least three states is discretely set.

12. A method for setting a display device, comprising:

acquiring a target value of a display setting including color temperature and brightness for a display device configured to display an image;

acquiring a measured value of display characteristics including the color temperature and the brightness in each of a plurality of preset states specific to the display device, from the display device for which the display setting is sequentially changed to the plurality of preset states; and determining a setting value in the display setting including the color temperature and the brightness from among the plurality of preset states, on the basis of the target value and a plurality of the measured values acquired in each of the plurality of preset states in the acquiring.

13. A non-transitory computer readable medium storing a program causing a computer to execute a process, the process comprising:

acquiring a target value of a display setting including color temperature and brightness for a display device configured to display an image;

acquiring a measured value of display characteristics including the color temperature and the brightness in each of a plurality of preset states specific to the display device, from the display device for which the display setting is sequentially changed to the plurality of preset states; and determining a setting value in the display setting including the color temperature and the brightness from among the plurality of preset states, on the basis of the target value and a plurality of the measured values acquired in each of the plurality of preset states in the acquiring.

* * * * *